US007728854B2

(12) United States Patent
Kim et al.

(10) Patent No.: US 7,728,854 B2
(45) Date of Patent: Jun. 1, 2010

(54) GAMMA CORRECTION DEVICE, DISPLAY APPARATUS INCLUDING THE SAME, AND METHOD OF GAMMA CORRECTION THEREIN

(75) Inventors: Hyoung-Rae Kim, Hwaseong-si (KR); Jong-Seon Kim, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1169 days.

(21) Appl. No.: 11/335,522

(22) Filed: Jan. 20, 2006

(65) Prior Publication Data

US 2006/0164355 A1 Jul. 27, 2006

(30) Foreign Application Priority Data

Jan. 25, 2005 (KR) ..... 2005-06839

(51) Int. Cl.
*G09G 5/00* (2006.01)

(52) U.S. Cl. ..... 345/690

(58) Field of Classification Search ..... 345/690, 345/89, 98, 204, 691; 348/220, 254
See application file for complete search history.

(56) References Cited

U.S. PATENT DOCUMENTS 5,990,949 A * 11/1999 Haruki ..... 348/254
6,067,063 A 5/2000 Kim et al.
7,023,458 B2 * 4/2006 Kudo et al. ..... 345/690
2002/0027551 A1 * 3/2002 Nitta et al. ..... 345/204
2002/0180680 A1 12/2002 Moon
2004/0004566 A1 * 1/2004 Walton et al. ..... 341/150
2004/0036708 A1 * 2/2004 Evanicky et al. ..... 345/691
2004/0217981 A1 * 11/2004 Bu ..... 345/690
2005/0017989 A1 * 1/2005 Huang ..... 345/690

FOREIGN PATENT DOCUMENTS

EP 1 486 944 A1 12/2004
JP 11-045074 2/1999
JP 2002-366112 12/2002

(Continued)

OTHER PUBLICATIONS

Korean Office Action dated Aug. 31, 2006 and English Translation.

*Primary Examiner*—Richard Hjerpe
*Assistant Examiner*—Shaheda A Abdin
(74) *Attorney, Agent, or Firm*—Harness, Dickey & Pierce, P.L.C.

(57) ABSTRACT

A gamma correction device and method thereof is described herein, in which gray-scale voltages may be generated that correspond with a plurality of gamma values. The gray-scale voltages may be generated by adjusting output ranges of the gray-scale voltages while fixing a gamma correction voltage on a constant level. The gamma correction device may include a gamma correction voltage generator generating a plurality of gamma correction voltages corresponding to a reference gamma value; a gray-scale voltage generation circuit dividing the gamma correction voltages to generate a plurality of sub gray-scale voltage sets each of which includes a sub gray-scale voltage corresponding to each gamma value; and a gray-scale voltage selection circuit outputting one of the sub gray-scale voltages of each sub gray-scale voltage set as a gray-scale voltage.

36 Claims, 8 Drawing Sheets

FOREIGN PATENT DOCUMENTS

| | | |
|---|---|---|
| KR | 1998-039141 | 8/1998 |
| KR | 10-2004-0056748 | 7/2004 |
| KR | 10-2004-0098569 | 11/2004 |
| KR | 10-2004-0103281 | 12/2004 |
| KR | 10-2005-0005259 | 1/2005 |
| KR | 10-2005-0064389 | 6/2005 |
| KR | 10-2006-0018391 | 3/2006 |
| KR | 10-2006-0018392 | 3/2006 |
| KR | 10-2006-0044099 | 5/2006 |
| TW | 531729 B | 5/2003 |
| TW | 558714 B | 10/2003 |

* cited by examiner

GAMMA CORRECTION DEVICE, DISPLAY APPARATUS INCLUDING THE SAME, AND METHOD OF GAMMA CORRECTION THEREIN

PRIORITY STATEMENT

This U.S. non-provisional patent application claims priority under 35 U.S.C. §119 to Korean Patent Application 2005-06839 filed on Jan. 25, 2005, the entire contents of which are herein incorporated by reference.

BACKGROUND

1. Field of Invention

The present invention relates to a gamma correction device, method thereof, and display apparatuses including a gamma correction device.

2. Description of Related Art

Various types of flat panel display apparatuses are widely used. Generally, flat display apparatuses are classified into emissive and non-emissive display types. Light-receiving (e.g., non-emissive) display apparatuses include liquid crystal displays (LCDs), while light-emissive display apparatuses include plasma display panels (PDPs), electroluminescent displays (ELDs), light emitting diodes (LEDs), vacuum fluorescent displays (VFDs). LCDs are most widely used in application with mobile apparatus on the merits of high picture quality, lightness, thinness, and low power consumption.

FIG. 1 is a functional block diagram of a general LCD apparatus 100, illustrating a schematic architecture applicable to a mobile unit. Referring to FIG. 1, an LCD apparatus may include an LCD panel 10 displaying image signals, and an LCD driver 190 applying drive signals to the LCD panel 10.

LCD panel 10 may be a unit constructed with a pair of transparent substrates between which liquid crystals are injected. On one of the two transparent substrates, gate lines may be arranged at constant intervals. Data lines may be arranged at constant intervals perpendicular to the gate lines. At regions corresponding to intersections between gate lines and data lines, thin film transistors may be arranged in matrix patterns. Each thin film transistor may correspond to a pixel. Color filters of red (R), green (G), and blue (B) may be arranged on other regions of the substrate. On a back side of the LCD panel 10, a backlight (not shown) may be arranged to provide a uniform light source for the LCD panel 10. For example, a light source for the backlight may be used with a cold cathode fluorescent lamp (CCFL).

An LCD driver 190 may include a plurality of control circuits, for example, a gate driver 20, a data driver 30, a timing controller 40, a gamma correction voltage generator 120, a gray-scale voltage generator 150, etc. In a mobile unit, an LCD driver 190 may be a single chip.

A timing controller 40 may generate control signals (e.g., a gate clock, a gate-on signal, etc.) required for operating a gate driver 20 and a data driver 30 in response to a clock signal CLK. A gray-scale voltage generator 150 may output a plurality of gray-scale voltages Vg used as references for generating LCD drive voltages. A gate driver 20 may scan pixels of an LCD panel 10 by a line in sequence. A data driver 30 may generate LCD drive voltages, corresponding to color signals RGB provided by a timing controller 40 in response to gray-scale voltages Vg provided by a gray-scale voltage generator 150. LCD drive voltages generated by a data driver 30 may be applied to an LCD panel every scanning cycle.

Conventionally, a characteristic of light transmittance in a liquid crystal is not linearly related to voltage levels, and brightness for input gray scales is linearly varied. In other words, if image data is varied and/or the brightness (e.g., luminance) of a backlight is varied, the picture quality appearing on an LCD apparatus 100 may be varied. Thus, a gamma correction voltage generator 120 may control contrast and brightness for images by regulating gamma characteristics to offer improved and/or optimum picture qualities based on operational conditions. A conventional LCD apparatus 100 as shown in FIG. 1 may perform gamma correction by modifying the gamma voltage, for example.

A gamma correction voltage generator 120 may output a plurality of the gamma correction voltages (e.g., eight in number) as a result of regulating gamma characteristics. A gray-scale voltage generator 150 may receive gamma correction voltages from a gamma correction voltage generator 120 and/or generate gray-scale voltages Vg with more defined voltage levels (e.g., 64 levels). A technique for regulating the contrast and/or brightness of pictures by means of gamma characteristics in an LCD apparatus 100 is referred to as 'gamma correction'. Gamma ($\gamma$) is a gradient of a line representing an input value vs. an output value of data. The output value is defined by a relation of $(\text{Inputvalue})^{1/\gamma}$. For example, if a gamma value is 1.0, there is no variation in the input value (i.e., null transformation). If a gamma value is larger than 0.0 and smaller than 1.0, the picture is dimmed. And, if a gamma value is larger than 1.0, the picture is brightened.

A way to provide gamma correction is to apply gamma values fixedly assigned to various types of displays in order to correct input/output characteristics of a display apparatus. For example, the National Television System Committee (NTSC) provides televisions operable at a gamma value of 2.2, while the Phase Alternate Line (PAL)/Sequential Color and Memory (SECAM) provide televisions operable at gamma value of 2.8. Gamma correction voltages corresponding to a gamma value (e.g., output luminance values for input gray scales) may be arranged in a lookup table LUT. The values stored in the lookup table may correspond with gray-scale voltages.

However, because a gamma correction scheme as described above uses a fixed gamma value, it is difficult and/or impossible to adapt for variations in image data and brightness of a backlight (e.g., variations in displaying environments). In order to overcome these problems, a gamma voltage generator 120 may have a plurality of lookup tables corresponding to a plurality of gamma values. However, as lookup tables need to store offset values for all gray-scale voltages, it may be necessary to prepare numerous registers, which may increase chip size.

Furthermore, to provide lookup tables for various gamma values, a manufacturer has to measure gray-scale values that correspond with each gamma value to be stored in registers. Therefore, as a number of gamma values increase, time and costs for determining values to be stored in registers increases.

SUMMARY OF THE INVENTION

Example embodiments of the present invention provide gamma correction devices and methods of gamma correction. Example embodiments of the present invention may provide devices and methods capable of performing minute gamma corrections based on variations in image data and brightness of a backlight, while reducing and/or minimizing a chip size and a cost of a gamma correction device. Reducing and/or minimizing chip size and/or the complexity of a gamma correction device may enable a device incorporating the gamma correction device, for example a mobile unit, to be lighter, thinner and more power efficient.

An example embodiment of the present invention provides a method of gamma correction. The method may include generating a plurality of gamma correction voltages corresponding to a reference gamma value; dividing the gamma correction voltages to generate a plurality of sub gray-scale voltages corresponding to a plurality of gamma values including the reference gamma value; and outputting a sub gray-scale voltage corresponding to one of the plurality gamma values.

An example embodiment of the present invention provides a method of gamma correction. The method may include generating a plurality of gamma correction voltages corresponding to a reference gamma value; dividing the gamma correction voltages to generate a plurality of sub gray-scale voltage sets each of which includes a sub gray-scale voltage corresponding to each gamma value; and outputting one of the sub gray-scale voltages of each sub gray-scale voltage set as a gray-scale voltage.

An example embodiment of the present invention provides a gamma correction device. The gamma correction device may include a gamma correction voltage generator generating a plurality of gamma correction voltages corresponding to a reference gamma value; a gray-scale voltage generation circuit dividing the gamma correction voltages to generate a plurality of sub gray-scale voltages corresponding to a plurality of gamma values including the reference gamma value; and a gray-scale voltage selection circuit outputting a sub gray-scale voltage corresponding to one of the plurality gamma values.

An example embodiment of the present invention provides a gamma correction device. The gamma correction device may include a gamma correction voltage generator generating a plurality of gamma correction voltages corresponding to a reference gamma value; a gray-scale voltage generation circuit dividing the gamma correction voltages to generate a plurality of sub gray-scale voltage sets each of which includes a sub gray-scale voltage corresponding to each gamma value; and a gray-scale voltage selection circuit outputting one of the sub gray-scale voltages of each sub gray-scale voltage set as a gray-scale voltage.

An example embodiment of the present invention provides a display apparatus. The display apparatus may include a gamma correction voltage generator generating a plurality of gamma correction voltages corresponding to a reference gamma value; a gray-scale voltage generation circuit dividing the gamma correction voltages to generate a plurality of sub gray-scale voltages corresponding to a plurality of gamma values including the reference gamma value; a gray-scale voltage selection circuit outputting a sub gray-scale voltage corresponding to one of the plurality of gamma values; a driver generating a drive voltage to display image data in response to the image data and the output sub gray-scale voltage; and a display panel displaying the image data in response to the drive voltage.

According to an example embodiment of the present invention, a reference gamma value may control the gamma correction voltages to be generated with uniformity.

According to an example embodiment of the present invention, gamma correction voltages may be generated in response to a plurality of offset values corresponding to the reference gamma value and a plurality of offset values defined by a user.

According to an example embodiment of the present invention, sub gray-scale voltages may be generated by subdividing the voltage-dividing points.

According to an example embodiment of the present invention, sub gray-scale voltages may be generated using a number of resistors that is greater than a number of sub gray-scale voltages.

According to an example embodiment of the present invention, a gray-scale voltage is a result of performing gamma correction based on one of a plurality gamma values.

According to an example embodiment of the present invention, a gray-scale voltage may be variable according to an input by a user, a display, and environment variations in image signals and/or display patterns.

According to an example embodiment of the present invention, lookup tables associated with gamma values and/or additional circuits used adjust the gamma correction voltages may be unnecessary.

BRIEF DESCRIPTION OF THE DRAWINGS

Example embodiments of the present invention will be more clearly understood from the detailed description taken in conjunction with the accompanying drawings.

DETAILED DESCRIPTION OF PREFERRED EMBODIMENTS

Figure 1:
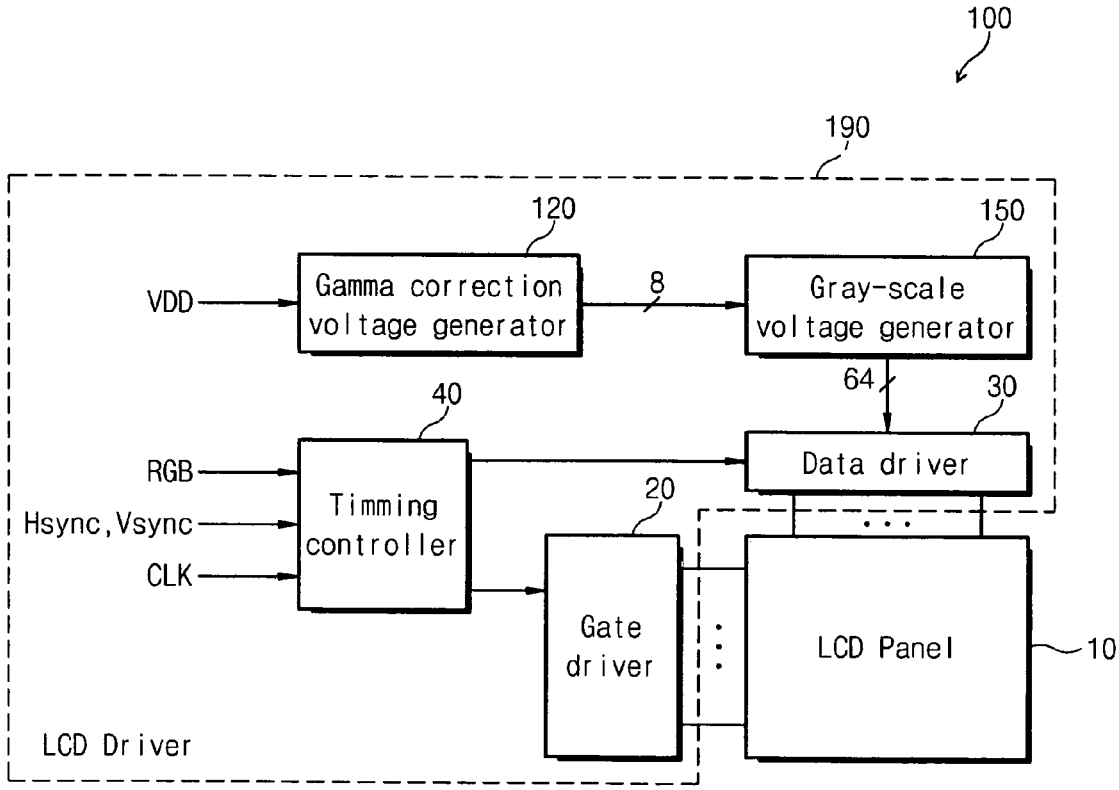
Fig. 1 (Prior Art)
FIG. 1 is a functional block diagram of a conventional liquid crystal display apparatus.

Various example embodiments of the present invention will now be described more fully with reference to the accompanying drawings in which some example embodiments of the invention are shown. Like numbers refer to like elements throughout the description of the drawings.

Detailed illustrative embodiments of the present invention are disclosed herein. However, specific structural and functional details disclosed herein are merely representative for purposes of describing example embodiments of the present invention. This invention may, however, may be embodied in many alternate forms and should not be construed as limited to only the embodiments set forth herein. It should be understood, that all modifications, equivalents, and alternatives to example embodiments of the present invention fall within the scope of the invention.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or" includes any and all combinations of one or more of the associated listed items.

It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the FIGS. For example, two FIGS. shown in succession may in fact be executed substantially concurrently or may sometimes be executed in the reverse order, depending upon the functionality/acts involved.

According to an example embodiment of the present invention, a gamma correction device and method thereof, which may be included in an LCD apparatus, may be configured to regulate output ranges of gray-scale voltages based on fixing a gamma correction voltage and generating gray-scale voltages corresponding to a plurality of gamma values. According to an example embodiment of the present invention, gamma correction corresponding to various gamma values may be performed by adjusting output ranges of gray-scale voltages.

Figure 2:
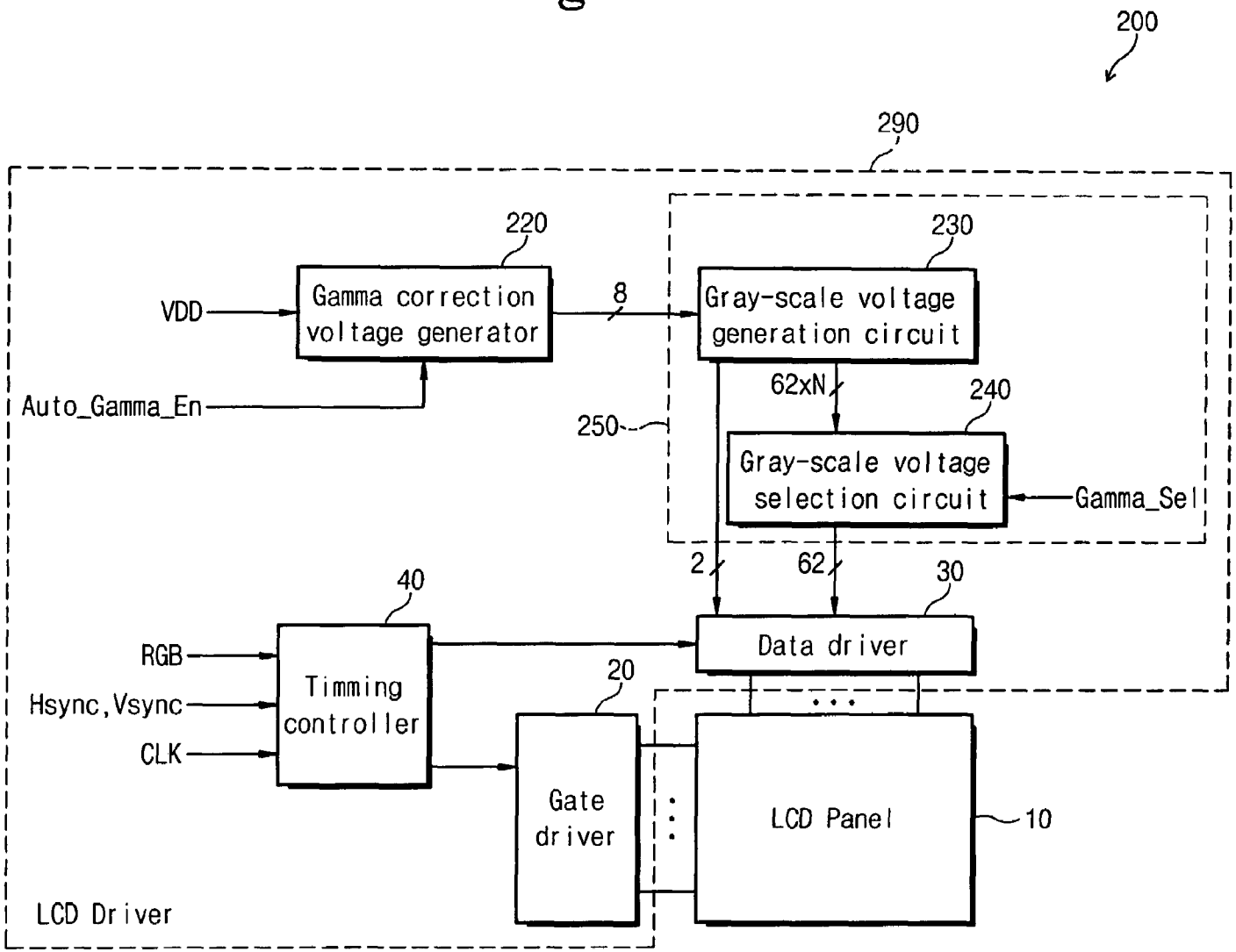
FIG. 2 is a functional block diagram of a liquid crystal display apparatus in accordance with an example embodiment of the present invention.

FIG. 2 is a functional block diagram of a LCD apparatus 200 in accordance with an example embodiment of the present invention. A LCD apparatus 200 may generate gray-scale voltages corresponding to a plurality of gamma values by regulating output ranges of the gray-scale voltages while fixing a gamma value on a constant level. Although FIG. 2 illustrates gamma correction with respect to a mobile-specific LCD apparatus 200, the invention is adoptable to various immovable display apparatuses (e.g., televisions, monitors, etc). Further, the present invention is applicable to other display apparatus, for example, PDP, ELD, LED, VFD, etc.

The LCD apparatus 200 shown in FIG. 2 is similar to the circuit structure of FIG. 1. Accordingly, LCD apparatus 200 will be described for the sake of brevity without repeating a description of components as previously described with respect to FIG. 1.

Referring to FIG. 2, a gamma correction voltage generator 220 may output a number of gamma correction voltages. For example, eight gamma correction voltages may be output based on a gamma reference value (e.g., 1.0) to provide an optical transmittance that is linearly variable with a voltage of the LCD panel 10. According to an example embodiment of the present invention, if a gamma value is 1.0, there is no variation on input/output image data, this scenario may be referred to as a null transformation. Gamma correction voltages output from a gamma correction voltage generator 220 may be fixed to constant levels and a gamma correcting operation may be substantially carried out by a gray-scale voltage generator 250 according to an example embodiment of the present invention.

Figure 3:
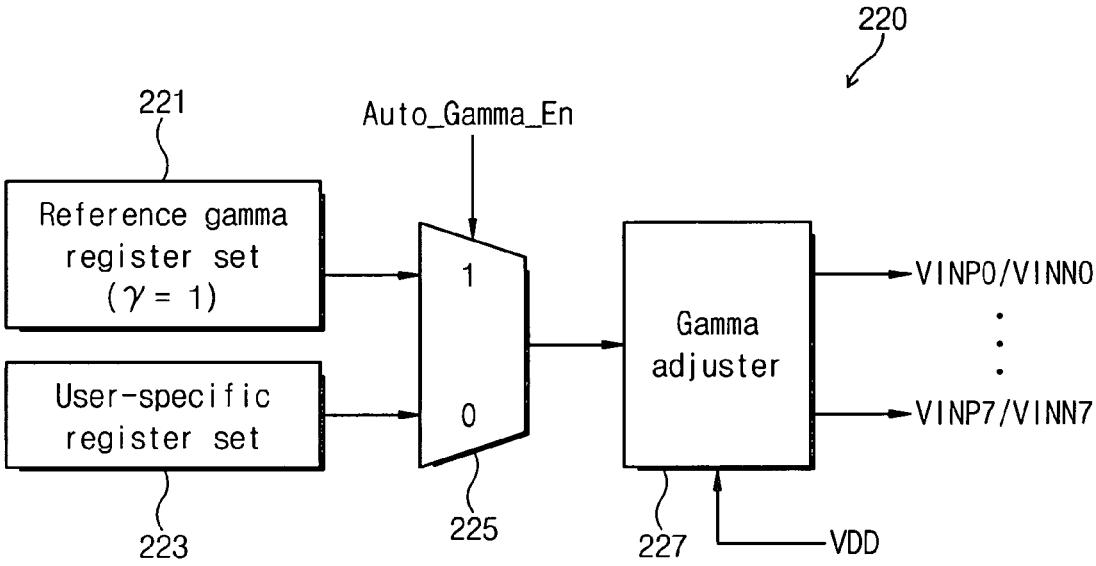
FIG. 3 is a detailed block diagram of a gamma correction voltage generator shown in FIG. 2 in accordance with an example embodiment of the present invention.

FIG. 3 is a detailed block diagram of a gamma correction voltage generator 220 shown in FIG. 2. Referring to FIG. 3 a gamma correction voltage generator 220 may include a reference gamma register set 221, a user-specific gamma register set 223, a data selection circuit 225, and a gamma adjustor 227. A reference gamma register set 221 may store gamma correction offset data corresponding to a reference gamma value of 1.0, for example. Offset data may correspond with gray-scale voltages. A user-specific gamma register set 223 may store gamma correction offset data defined by, for example, manufacturers of mobile units. Offset data stored in a user-specific gamma register set 223 may also correspond with gray-scale voltages.

A data selection circuit 225 may output offset data from a reference gamma register set 221 and/or user-specific gamma registers 223, in response to an automatic gamma activation signal Auto_Gamma_En. For example, a data selection circuit 225 may output offset data from the reference gamma register 221 when an automatic gamma activation signal Auto_Gamma_En is set on "1", and the data selection circuit 225 may output offset data from a user-specific gamma register 221 when the automatic gamma activation signal Auto_Gamma_En is set on "0". An automatic gamma activation signal Auto_Gamma_En may be received directly and/or indirectly from a user through an interface (not shown) of an LCD driver 290. Further, an automatic gamma activation signal Auto_Gamma_En may be designed to be automatically determined based on, for example, variation in image data and brightness (e.g., luminance) of a backlight.

A gamma adjustor 227 may generate, for example, eight gamma correction voltages in response to gamma correction offset data provided by data selection circuit 225 and a power source voltage VDD. A LCD apparatus 200 may operate in an analog drive mode that may apply image data of positive polarity to pixels during a time T to display a picture frame and may then apply image data of negative polarity to pixels during the next time T to display a next picture frame. Accordingly, a gamma correction voltage generator 220 may alternately generate eight gamma correction voltages VINP0/VINN0~VINP7/VINN7.

Returning to FIG. 2, a gray-scale voltage generator 250 may include a gray-scale voltage generation circuit 230 and a gray-scale voltage selection circuit 240. A gray-scale voltage generation circuit 230 may receive gamma correction voltages VINP0/VINN0~VINP7/VINN7 and output a plurality of sub gray-scale voltage sets corresponding to gray-scale levels. Each sub gray-scale voltage set may include sub gray-scale voltages corresponding to a plurality of gamma values. A gray-scale voltage selection circuit 240 may select one sub gray-scale voltage in each sub gray-scale voltage set in response to a gamma selection signal Gamma_Sel. A selected sub gray-scale voltage may be output as a corrected gray-scale voltage. Gray-scale voltages generated from the gray-scale voltage generator 250 may be divided into a plurality of levels. For example gray-scale voltages generated by a gray-scale voltage generator 250 may be divided into 64 (or 256)

levels. Among the 64 gray-scale voltages, a first and last gray-scale voltage, e.g., Vg0 and Vg63, may correspond to black and white data, respectively. Accordingly, the first and the last gray-scale voltages may be input directly to a data driver 30 without being further processed.

According to an example embodiment of the present invention, a gray-scale voltage may be varied to different levels under a constant gamma voltage. Accordingly, gamma correction may be performed by selecting one of various gray-scale voltages.

Figure 4:
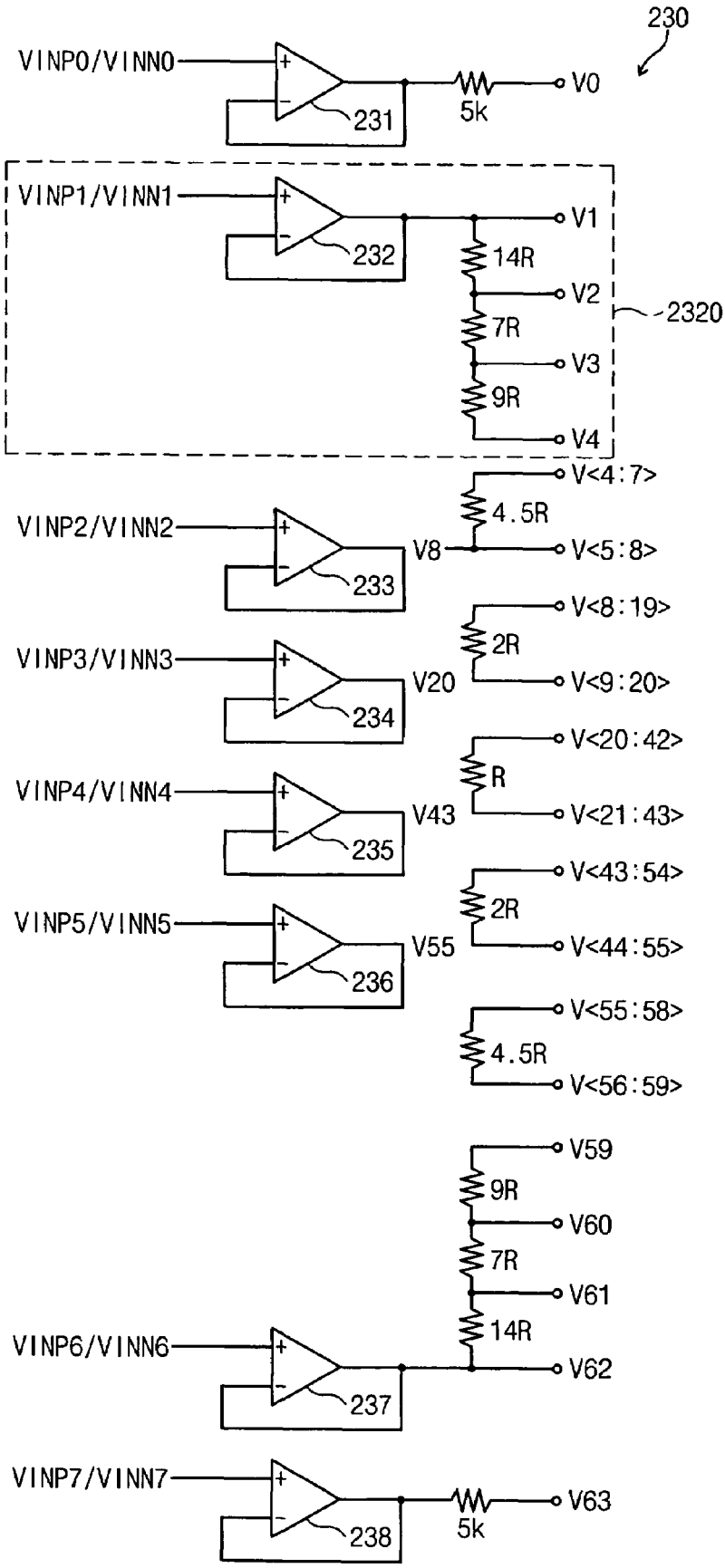
FIG. 4 is a detailed circuit diagram of a gray-scale voltage generation circuit shown in FIG. 2 in accordance with an example embodiment of the present invention.

FIG. 4 is a detailed circuit diagram of a gray-scale voltage generation circuit 230 according to an example embodiment of the present invention as shown in FIG. 2.

Referring to FIG. 4, a gray-scale voltage generation circuit 230 may include a plurality of voltage followers 231~238 and a plurality of resistors dividing gamma correction voltages VINP0/VINN0~VINP7/VINN7 applied through voltage followers 231~238. Voltage followers 231~238 may receive gamma correction voltages VINP0/VINN0~VINP7/VINN7 from a gamma correction voltage generator 220. Each voltage follower may be an amplification circuit operable with a gain of 1. Voltage followers 231~238 may amplify currents without variations on voltages. Accordingly, effects of voltage loss due to internal resistance may be reduced and/or prevented by lowering an impedance of input signals which may also improve a signal-to-noise ratio (SNR) of a device.

According to an example embodiment of the present invention, resistors coupled to the voltage followers 231~238 may be connected with each other in series as shown in FIG. 4. Resistors may be used to generate a plurality sub gray-scale voltages by dividing gamma correction voltages, for example, VINP0/VINN0~VINP7/VINN7 supplied through voltage followers 231~238. An example structure of a circuit generating such gray-scale voltages using a plurality of resistors is disclosed in U.S. Pat. No. 6,067,063 entitled "LIQUID CRYSTAL DISPLAY HAVING A WIDE VIEW ANGLE AND METHOD FOR DRIVING THE SAME," which issued to Kim et al. on May 23, 2000 is hereby incorporated in its entirety by reference.

A gray-scale voltage generation circuit according to an example embodiment of the present invention provides a plurality of sub gray-scale voltages V1, V1*a*, V1*b*. For example, voltages denoted by V0~V63 in FIG. 4 may be sub gray-scale voltages corresponding to a gamma value of 1.0. Those voltages V0~V63 may be similar and/or identical to gray-scale voltages generated when a gamma value is set on 1.0. Generating sub gray-scale voltages using a gray-scale voltage generation circuit 230 is described below.

Figure 5:
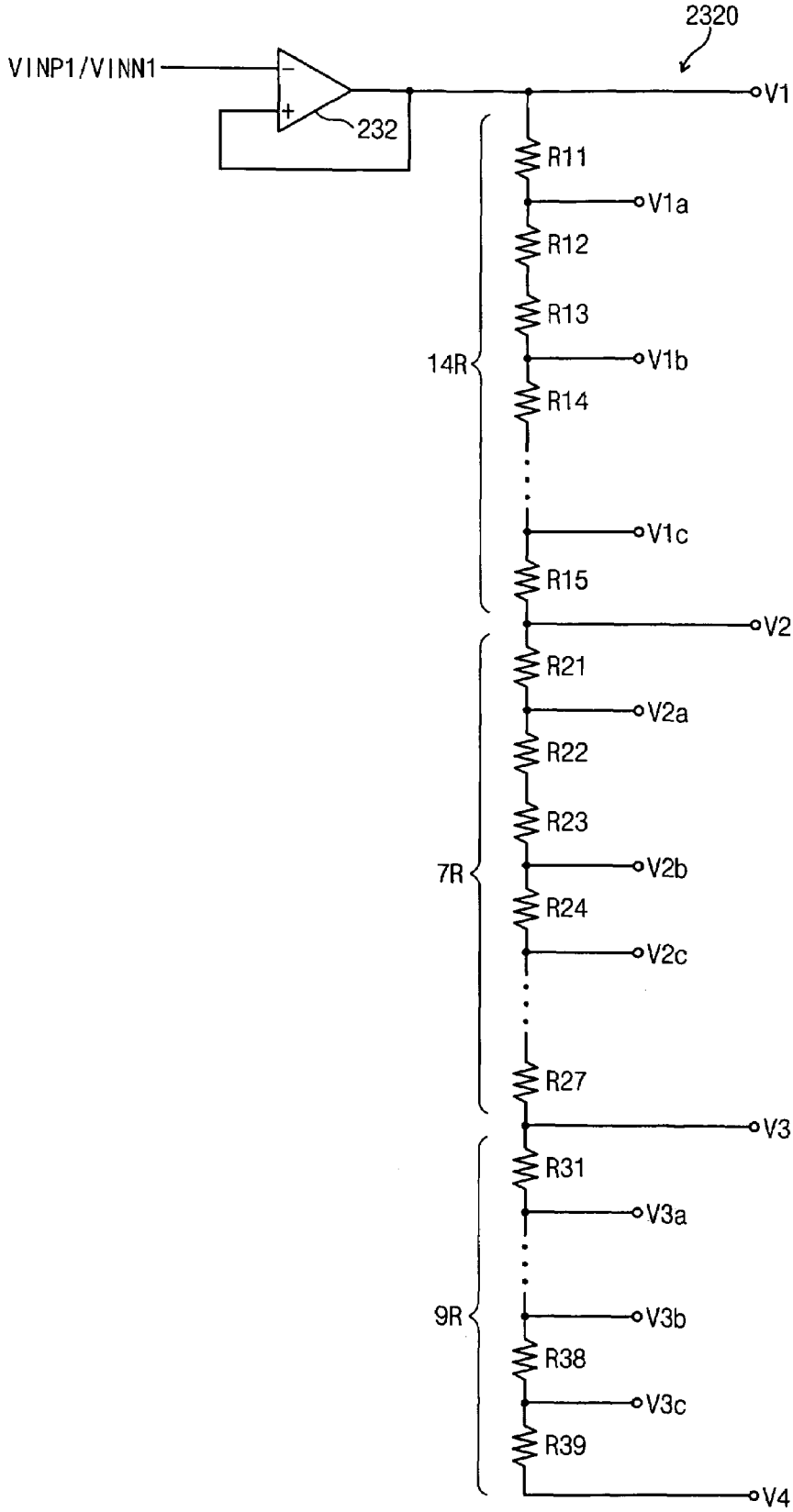
FIG. 5 is a detailed circuit diagram for the part enclosed by a dotted line in FIG. 4 in accordance with an example embodiment of the present invention.

FIG. 5 is a detailed circuit diagram for the part enclosed by a dotted line 2320 in FIG. 4. Referring to FIG. 5, a gray-scale voltage generation circuit 230 may provide a plurality of sub gray-scale voltages V1/V1*a*/V1*b*/V1*c*, V2/V2*a*/V2*b*/V2*c*, etc., each of which is herein referred to as a sub gray-scale voltage set. A number of the sub gray-scale voltage sets may increase proportionally with a depth of resolution in a display apparatus. Sub gray-scale voltages belonging to each sub voltage set, e.g., V1, V1*a*, V1*b*, and V1*c*, may correspond to different gamma values. For example, a sub gray-scale voltage V1 may correspond with a gamma value of 1.0; and a sub gray-scale voltage V1*a* may correspond with a gamma value of 1.8; a sub gray-scale voltage V1*b* may correspond with a gamma value of 2.2, and a sub gray-scale voltage V1*c* may correspond with a gamma value of 2.5.

According to an example embodiment of the present invention, differences between adjacent gray-scale voltages may vary. Accordingly, resistance values used to establish gray-scale voltages may vary. For example, a resistor 14R (R is unit resistance) may be connected between adjacent voltage terminals of V1 and V2, while a resistor 7R may be connected between the voltage terminals of V2 and V3. Further, according to an example embodiment of the present invention, a gray-scale voltage generation circuit may include several resistors having the same resistance values to reduce errors of divided values, instead of a plurality of resistors with different resistance values. For example, 14 unit resistors, each having the unit resistance value R, may be connected between voltage terminals V1 and V2 in series, while 7 unit resistors may be connected between voltage terminals of V2 and V3 in series.

According to an example embodiment of the present invention, voltage-dividing points may be subdivided and used to generate a plurality of sub gray-scale voltage sets corresponding to a plurality of gamma voltages. In other words, an example embodiment of the present invention may further subdivide voltage-dividing points into finer sections and then generate a plurality of sub gray-scale voltages, without adding circuits to the sub gray-scale voltages thereto. As described above, a sub gray-scale voltage set may refer to a plurality of sub gray-scale voltages generated when a gamma voltage is applied. The following describes a procedure of determining levels of sub gray-scale voltages.

Figure 6:
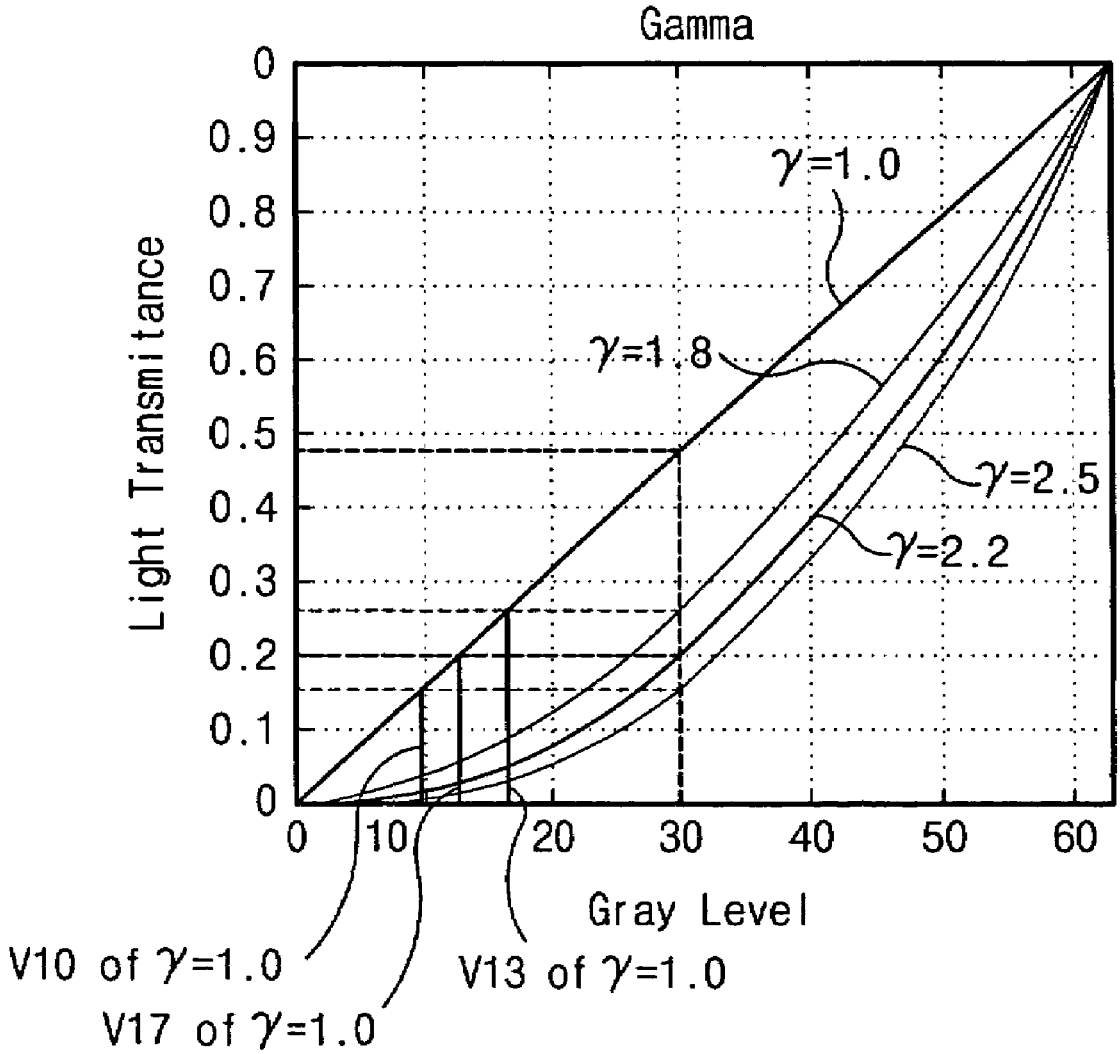
FIG. 6 is a graphic diagram showing curves when gamma values are 1.0, 1.8, 2.2, and 2.5 in accordance with an example embodiment of the present invention.

FIG. 6 is a graphic diagram showing a relationship between different gamma values relating to light transmittance and gray level voltages. FIG. 6 includes curves for gamma values of 1.0, 1.8, 2.2 and 2.5.

Referring to FIG. 6, the V30 voltage generated when the gamma value is 1.8 may be substantially identical to a V17 voltage generated when the gamma value is 1.0. Further, a V30 voltage generated when the gamma value is 2.5 may be substantially identical to the V10 voltage generated when the gamma value is 1.0. Accordingly, a gray-scale voltage may go from V30 to V17 when a gamma value changes from 1.8 to 1.0. Further, a gray-scale voltage may go from V30 to V10 when the gamma value changes from 2.5 to 1.0.

As shown in the example of FIG. 6, a change in, for example, voltages V30, V17, V13, and V10, when the gamma value is 1.0 may correspond to a change in gamma value, for example, 1.0 to 1.8, 2.2, or 2.5 at a V30 voltage. Example embodiments of the present invention utilize the relationships of gamma curves by mapping gray-scale voltages, corresponding to different gamma values, to gray-scale voltages assigned to a reference gamma value, for example 1.0. Voltage-dividing points are determined to obtain the mapped voltages using resistors. Accordingly, adjusting an output range of a gray-scale voltage generated with respect to a reference gamma value of, for example, 1.0 may be used to generate a plurality of gray-scale voltages associated with different gamma values as they are generated from a gamma correction voltage generator 220.

As can be seen from FIG. 6, voltages V0~V63 gray-scale voltages generated when the gamma value is 1.0 and gray-scale voltages generated when the gamma value is not 1.0 may not agree. Accordingly, an example embodiment of the present invention may provide sub gray-scale voltage sets, V1*a*~V1*c*, V2*a*~V2*c*, etc., which may be further subdivisions of previously defined gray-scale voltages V0~V63, in order to make gray-scale voltages for gamma values different from a reference gamma value be substantially identical to gray-scale voltages assigned to the gamma value of 1.0. According to an example embodiment of the present invention, the additional sub gray-scale voltage sets, V1*a*~V1*c*, V2*a*~V2*c*, may be generated by further subdividing voltage-dividing points arranged among a plurality of resistors.

Referring to FIG. 2, a plurality of sub gray-scale voltage sets provided by a gray-scale voltage generation circuit 230 may be input to a gray-scale voltage selection circuit 240. A gray-scale voltage selection circuit 240 may select one of the sub gray-scale voltages in each sub gray-scale voltage set in response to a gamma selection signal Gamma_Sel. A selected one of the sub gray-scale voltages may be supplied as a corrected gray-scale voltage.

Figure 7:
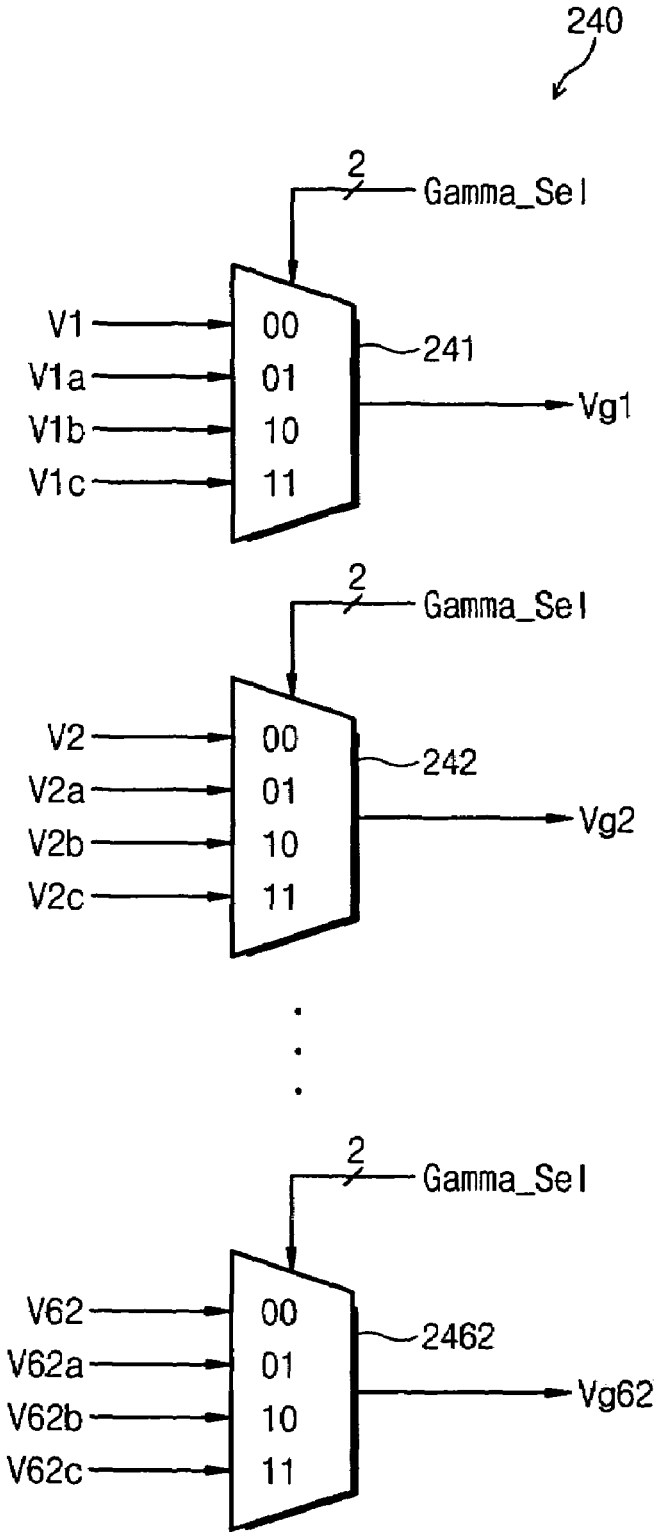
FIG. 7 is a detailed circuit diagram of the gray-scale voltage selection circuit shown in FIG. 2 in accordance with an example embodiment of the present invention.

FIG. 7 is a detailed circuit diagram of a gray-scale voltage selection circuit 240 shown in FIG. 2. Referring to FIG. 7, a gray-scale voltage selection circuit 240 may include a plurality of data selection circuits 241~2462. Each of the data selection circuits 241~2462 may include an N:1 multiplexer selecting one of N data bits in response to a gamma selection signal Gamma_Sel. Each of the data selection circuits 241~2462 may selectively drive one of the sub gray-scale voltages in each sub gray-scale voltage set in response to a gamma selection voltage Gamma_sel. For example, a gamma selection signal Gamma_Sel of "00" may be assigned to select a sub gray-scale voltage (e.g., V1) when a gamma value is 1.0; a gamma selection signal Gamma_Sel of "01" may be assigned to select a sub gray-scale voltage (e.g., V1*a*) when a gamma value is 1.8; a gamma selection signal Gamma_Sel of "10" may be assigned to select a sub gray-scale voltage (e.g., V1*b*) when a gamma value is 2.2; and a gamma selection signal Gamma_Sel of "11" may be assigned to select a sub gray-scale voltage (e.g., V1*c*) when a gamma value is 2.5. A sub gray-scale voltage selected by a data selection circuits 241~2462 may be output as a corrected gray-scale voltages Vg1~Vg62 that result from a gamma correction. According to an example embodiment of the present invention, a gamma selection signal Gamma_Sel having various data codes may be supplied directly and/or indirectly from a user by way of an interface (not shown) included in an LCD driver 290, and/or be automatically established to enable a gray-scale voltage to be output when a pattern of image data varies and/or a brightness (e.g., luminance) of a backlight changes.

Figure 8:
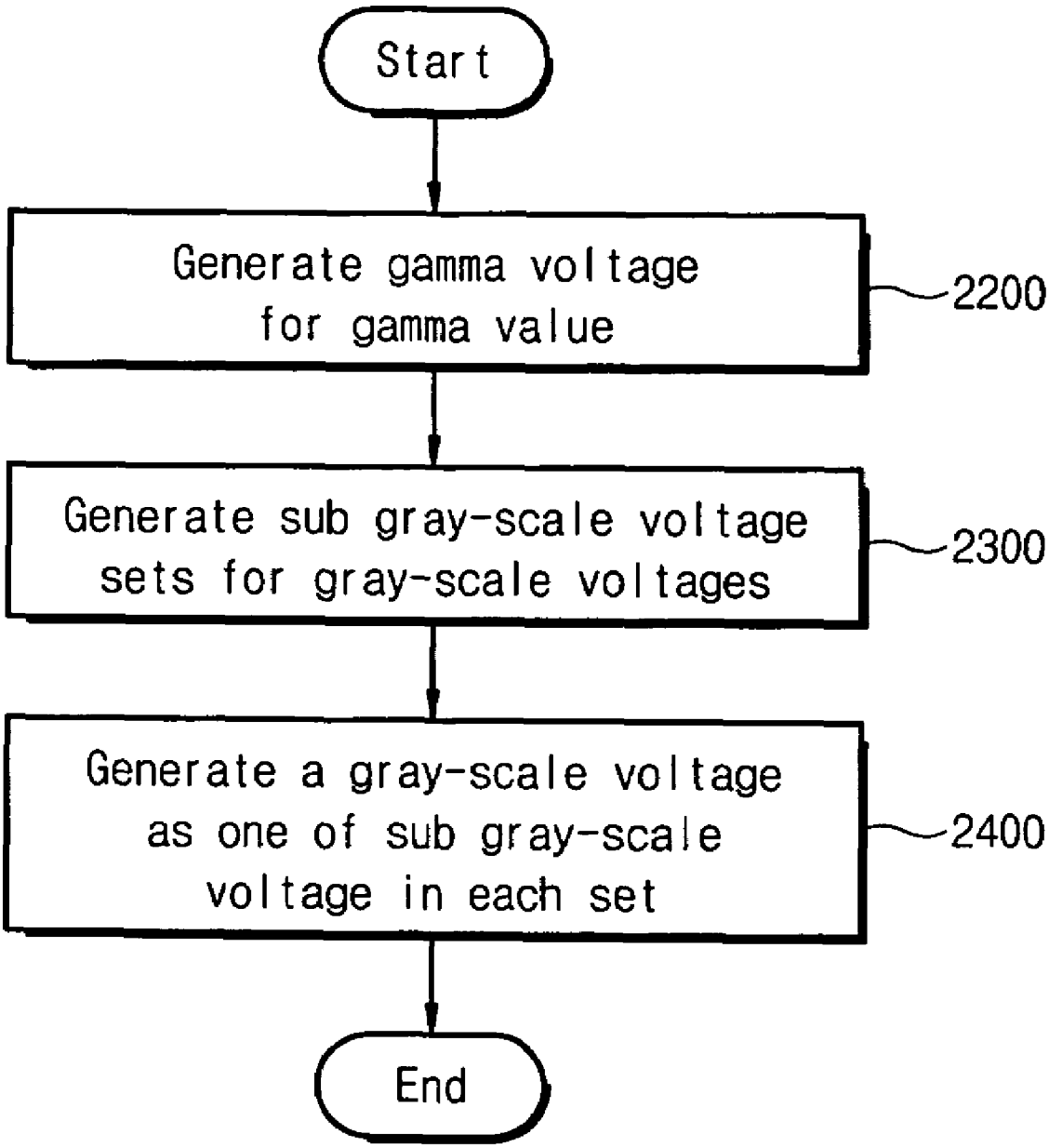
FIG. 8 is a flow chart showing a method of gamma correction in accordance with an example embodiment of the present invention.

FIG. 8 is a flow chart showing a method of gamma correction in accordance with an example embodiment of the present invention.

Referring to FIG. 8, a gamma correction method according to an example embodiment of the present invention may generate a plurality of gamma correction voltages VINP0/VINN0~VINP7/VINN7. The plurality of gamma correction voltages VINP0/VINN0~VINP7/VINN7 may be generated by a gamma correction voltage generator 200 based on a reference gamma value, for example, $\gamma$=1.0 (step 2200). A plurality of sub gray-scale voltage sets, V1~V1*c*, V2~V2*c*, etc., may be generated by dividing the gamma correction voltages VINP0/VINN0~VINP7/VINN7 into a plurality of sub gray-scale voltages with 64 or 256 levels using a gray-scale voltage generation circuit 230 (step 2300). Each of the sub gray-scale voltage sets may include a sub gray-scale voltage assigned to each of a plurality of gamma values (e.g., $\gamma$=1.0, $\gamma$=1.8, $\gamma$=2.2, and $\gamma$=2.5). A gray-scale voltage generation circuit may also select one of the sub gray-scale voltages for each sub gray-scale voltage set. A gray-scale voltage selection circuit 240 may output the sub gray-scale voltages, which may be selected from the sub gray-scale voltage sets V1~V1*c*, V2~V2*c*, etc., as a corrected gray-scale voltages Vg1, Vg2, etc. (step 2400).

As described above, a gamma correction device and method thereof may perform an efficient gamma correcting operation by generating a plurality of sub gray-scale voltages based on gray-scale levels utilizing characteristics of gamma curves. In other words, gray-scale voltages corresponding with a plurality of gamma values may be generated by adjusting an output range of a gray-scale voltage by fixing the gamma correction voltage on a constant level.

Although example embodiments of the present invention have been described in connection with the accompanying drawings, it is not limited thereto. It will be apparent to those skilled in the art that various substitutions, modifications and/or changes may be made to the example embodiments of the present invention without departing from the scope and spirit of the invention.

What is claimed is:

1. A method of gamma correction, comprising:

selecting a plurality of offset values from a reference gamma register or a user-specific gamma register in response to an automatic gamma activation signal;

generating a plurality of gamma correction voltages in response to the selected plurality of offset values corresponding to at least one of a plurality of gamma values;

dividing the gamma correction voltages to generate a plurality of sub gray-scale voltages corresponding to the plurality of gamma values; and outputting a sub gray-scale voltage corresponding to one of the plurality of gamma values, wherein the reference gamma register stores a plurality of values corresponding to a reference gamma value, and the user-specific gamma register stores a plurality of values defined by a user.

2. The method as set forth in claim 1, wherein the plurality of sub gray-scale voltages are generated at voltage-dividing points arranged among a plurality of resistors.

3. The method as set forth in claim 2, wherein the sub gray-scale voltages are generated by subdividing the voltage-dividing points.

4. The method as set forth in claim 1, wherein the reference gamma value controls the gamma correction voltages to be generated with uniformity.

5. A method of gamma correction, comprising:

selecting a plurality of offset values from a reference gamma register or a user-specific gamma register in response to an automatic gamma activation signal;

generating a plurality of gamma correction voltages in response to the selected plurality of offset values corresponding to at least one of a plurality of gamma values;

dividing the gamma correction voltages to generate a plurality of sub gray-scale voltage sets, where each of the sets includes a sub gray-scale voltage corresponding to each of the gamma values; and outputting one of the sub gray-scale voltages of each sub gray-scale voltage set as a gray-scale voltage, wherein the reference gamma register stores a plurality of values corresponding to a reference gamma value, and the user-specific gamma register stores a plurality of values defined by a user.

6. The method as set forth in claim 5, wherein the number of the sub gray-scale voltage sets is proportional to a resolution of a display unit.

7. The method as set forth in claim 5, wherein dividing the gamma correction voltages to generate the sub gray-scale voltages includes:

preventing voltage loss in the plurality of gamma correction voltages; and dividing the plurality of gamma correction voltages, wherein the plurality sub gray-scale voltages are generated at voltage-dividing points arranged among a plurality of resistors.

8. The method as set forth in claim 7, wherein the sub gray-scale voltages are generated by subdividing the voltage-dividing points.

9. The method as set forth in claim 7, wherein the step of dividing the plurality of gamma correction voltages is performed using a number of resistors that is greater than a number of sub gray-scale voltages.

10. The method as set forth in claim 5, wherein the gray-scale voltage is a result of gamma correction performed based on one of the plurality of gamma values.

11. The method as set forth in claim 5, wherein the reference gamma value controls the gamma correction voltages to be generated with uniformity.

12. The method as set forth in claim 5, wherein outputting one of the sub gray-scale voltages outputs the sub gray-scale voltage corresponding to one of the plurality of gamma values based on a gamma selection signal.

13. The method as set forth in claim 12, wherein the gamma selection signal is variable based on an input by a user.

14. The method as set forth in claim 12, wherein the gamma selection signal is variable based on a display.

15. The method as set forth in claim 12, wherein the gamma selection signal is changeable based on variations in image signals or display patterns.

16. A gamma correction device comprising:

a gamma correction voltage generator selecting a plurality of offset values from a reference gamma register or a user-specific gamma register in response to an automatic gamma activation signal, and generating a plurality of gamma correction voltages in response to the selected plurality of offset values corresponding to at least one of a plurality of gamma values;

a gray-scale voltage generation circuit dividing the gamma correction voltages to generate a plurality of sub gray-scale voltages corresponding to the plurality of gamma values; and a gray-scale voltage selection circuit outputting the sub gray-scale voltage corresponding to one of the plurality of gamma values, wherein the reference gamma register stores a plurality of values corresponding to a reference gamma value, and the user-specific gamma register stores a plurality of values defined by a user.

17. The gamma correction device as set forth in claim 16, wherein the plurality of sub gray-scale voltages are generated at voltage-dividing points arranged among a plurality of resistors.

18. The gamma correction device as set forth in claim 17, wherein the sub gray-scale voltages are generated by subdividing the voltage-dividing points.

19. The gamma correction device as set forth in claim 16, wherein the reference gamma value controls the gamma correction voltages to be generated with uniformity.

20. A gamma correction device comprising:

a gamma correction voltage generator selecting a plurality of offset values from a reference gamma register or a user-specific gamma register in response to an automatic gamma activation signal, and generating a plurality of gamma correction voltages in response to the selected plurality of offset values corresponding to at least one of a plurality of gamma values;

a gray-scale voltage generation circuit dividing the gamma correction voltages to generate a plurality of sub gray-scale voltage sets each of which includes a sub gray-scale voltage corresponding to each of the gamma values; and a gray-scale voltage selection circuit outputting one of the sub gray-scale voltages of each sub gray-scale voltage set as a gray-scale voltage, wherein the reference gamma register stores a plurality of values corresponding to a reference gamma value, and the user-specific gamma register stores a plurality of values defined by a user.

21. The gamma correction device as set forth in claim 20, wherein the number of the sub gray-scale voltage sets is proportional to a resolution of a display unit.

22. The gamma correction device as set forth in claim 20, wherein the gray-scale voltage generator comprises:

a voltage follower preventing voltage loss in the plurality of gamma correction voltages; and a plurality of resistors dividing the plurality of gamma voltages, wherein the plurality of sub gray-scale voltages are generated at voltage-dividing points arranged among the plurality of resistors.

23. The gamma correction device as set forth in claim 22, wherein the sub gray-scale voltages are generated by subdividing the voltage-dividing points.

24. The gamma correction device as set forth in claim 22, wherein the gray-scale voltage generation circuit includes a number of resistors larger than a number of sub gray-scale voltages.

25. The gamma correction device as set forth in claim 20, wherein the gray-scale voltage is a result of gamma correction performed based on one of the plural gamma values.

26. The gamma correction device as set forth in claim 20, wherein the reference gamma value controls the gamma correction voltages to be generated with uniformity.

27. The gamma correction device as set forth in claim 20, wherein the gray-scale voltage selection circuit includes a plurality of data selection circuits to output the sub gray-scale voltage corresponding to one of the plurality of gamma values in response to a gamma selection signal.

28. The gamma correction device as set forth in claim 27, wherein the gamma selection signal is variable based on an input by a user.

29. The gamma correction device as set forth in claim 27, wherein the gamma selection signal is variable based on a display.

30. The gamma correction device as set forth in claim 27, wherein the gamma selection signal is changeable based on variations in image signals or display patterns.

31. A display apparatus comprising:

a gamma correction device;

a driver generating a drive voltage to display image data in response to the image data and the output sub gray-scale voltage; and a display panel displaying the image data in response to the drive voltage, wherein the gamma correction device includes:

a gamma correction voltage generator selecting a plurality of offset values from a reference gamma register or a user-specific gamma register in response to an automatic gamma activation signal, and generating a plurality of gamma correction voltages in response to the selected plurality of offset values corresponding to at least one of a plurality of gamma values;

a gray-scale voltage generation circuit dividing the gamma correction voltages to generate a plurality of sub gray-scale voltages corresponding to the plurality of gamma values; and a gray-scale voltage selection circuit outputting the sub gray-scale voltage corresponding to one of the plurality of gamma values, wherein the reference gamma register stores a plurality of values corresponding to a reference gamma value, and the user-specific gamma register stores a plurality of values defined by a user.

32. The display apparatus as set forth in claim 31, wherein the plural sub gray-scale voltages are generated at voltage-dividing points differentially arranged among a plurality of resistors.

33. The display apparatus as set forth in claim 32, wherein the sub gray-scale voltages are generated by subdividing the voltage-dividing points.

34. The display apparatus as set forth in claim 31, wherein the reference gamma value controls the gamma correction voltages to be generated with uniformity.

35. The method as set forth in claim 1, wherein the automatic gamma activation signal is received from the user.

36. The method as set forth in claim 1, wherein the automatic gamma activation signal is automatically determined based on variation in image signals and brightness of a display.

* * * * *